United States Patent [19]

Van Auken

[11] Patent Number: 4,664,378

[45] Date of Patent: May 12, 1987

[54] ELECTRICALLY CONDUCTIVE TENNIS BALL

[76] Inventor: John A. Van Auken, 16 La Gorce Cr., Miami Beach, Fla. 33141

[21] Appl. No.: 560,239

[22] Filed: Dec. 12, 1983

Related U.S. Application Data

[63] Continuation-in-part of Ser. No. 320,066, Nov. 10, 1981, Pat. No. 4,433,840, which is a continuation of Ser. No. 77,729, Sep. 21, 1979, Pat. No. 4,299,394, which is a continuation-in-part of Ser. No. 683,283, May 5, 1976, abandoned, which is a continuation-in-part of Ser. No. 570,766, Apr. 23, 1975, abandoned.

[51] Int. Cl.[4] ..... A63B 61/00

[52] U.S. Cl. ..... 273/61 R; 428/242; 428/227; 340/323 R; 139/11

[58] Field of Search ..... 273/61 R, 61 B, 61 C, 273/61 D, 58 B, 58 BA; 428/242, 113, 283, 227, 229; 340/323 R; 139/11

[56] References Cited

U.S. PATENT DOCUMENTS

| | | | |
|---|---|---|---|
| 2,258,174 | 10/1941 | Chawner | 273/58 K |
| 3,009,235 | 11/1961 | de Mestral | 46/DIG. 1 |
| 3,396,970 | 8/1968 | Fraser, Jr. et al. | 273/61 R |
| 3,586,597 | 6/1971 | Okuhashi | 428/242 |
| 3,854,719 | 12/1974 | Supran | 273/61 R |
| 3,883,860 | 5/1975 | Von Kohorn | 273/61 R X |
| 3,927,881 | 12/1975 | Lemelson et al. | 46/DIG. 1 |
| 4,071,242 | 1/1978 | Supran | 273/61 R |
| 4,299,384 | 11/1981 | Van Auken | 273/61 R |
| 4,381,109 | 4/1983 | Kohorn | 273/61 R |
| 4,433,840 | 2/1984 | Van Auken | 273/61 R |

FOREIGN PATENT DOCUMENTS

| | | | |
|---|---|---|---|
| 714481 | 9/1954 | United Kingdom | 273/61 R |
| 1152240 | 5/1969 | United Kingdom | 273/61 B |

*Primary Examiner*—George J. Marlo
*Attorney, Agent, or Firm*—Hughes & Cassidy

[57] ABSTRACT

An electrically conductive tennis ball comprising a cover of woven fabric in which the yarn used for weaving the fabric in at least one direction is made by twisting together a blend of electrically conductive and electrically nonconductive filament fibers. The electrically nonconductive fibers may predominate, and the woof yarn may be thicker than the warp yarn which may be so woven with the woof yarn that the latter occupies the major part of the ball's surface. To promote continuity of the electrical paths in the ball's cover, an electrically conductive adhesive, or mat, or scrim or other base may be interposed between the woven cover, and an electrically conductive coating may be applied to the inner, or back, side of the cover. Needling may also be employed to reorient the fibers in the cover and thereby enhance the conductivity of the electrical paths along the inner side of the cover. Features of the invention such as those just described reduce the number of electrically conductive fibers needed to make the ball operate satisfactorily, eliminating objectionable discoloration of the ball attributable to those fibers and also eliminating changes in the playing characteristics of the ball which a greater number of those fibers might create. Tennis balls as just described may be made more conductive than water to keep water on the court from generating a false signal.

14 Claims, 14 Drawing Figures

ELECTRICALLY CONDUCTIVE TENNIS BALL

RELATED APPLICATIONS

This application is a continuation-in-part of my copending application Ser. No. 320,066 filed Nov. 10, 1981 (now U.S. Pat. No. 4,433,840 dated Feb. 28, 1984), which in turn is a continuation of my application Ser. No. 77,729 filed Sept. 21, 1979, now U.S. Pat. No. 4,299,394, which in turn is a continuation-in-part of my application Ser. No. 683,283 filed May 5, 1976 (now abandoned), which in turn is a continuation-in-part of my application Ser. No. 570,766 filed Apr. 23, 1975 (now abandoned).

FIELD OF INVENTION

This invention relates to improvements in electrically conductive tennis balls which are used with automatic tennis court line calling systems to detect whether the ball lands in or out of a tennis court playing area or strikes the top of the net. Line calling systems of this type have one or more sets of exposed spaced apart conductors extending along selected areas of the tennis court and the top of the net to sense touchdown of the electrically conductive ball.

When the ball lands across two or more of the sensing conductors, an electrical current-conducting circuit is completed through the ball to signal the players that the ball touched down in an area occupied by the conductors.

Electrical conductivity of the tennis ball may be established by incorporating electrically conductive fibers into the cover of the ball.

SUMMARY AND OBJECTS OF INVENTION

In accordance with this invention, a blend of electrically conductive and nonconductive fibers are spun together to form yarn which is used to weave the fabric for the tennis ball cover. The conductive and nonconductive fibers are random lengths of filaments, as opposed to staple fibers.

The electrically conductive fibers may be made from stainless steel. Alternatively, other types of electrically conductive fibers may be used such as those described in my U.S. Pat. No. 4,299,384.

In one embodiment of this invention, the electrically conductive fibers are preferably incorporated into just the woof or filling, and not the warp of the woven fabric. In another embodiment, the electrically conductive fibers are incorporated into both the woof and the warp. In both of these embodiments, the woof yarn is preferably made much thicker and thus coarser than the warp yarn and is woven with the warp in such a manner that the area occupied by the woof on the outer surface of the tennis ball cover is much greater than the area occupied by the warp.

In some of the illustrated embodiments the tennis ball advantageously includes an electrically conductive base which lies between the woven cover and the elastically deformable core of the ball to enhance electrical continuity amongst the conductive fibers in the cover. The electrically conductive base preferably extends entirely around the core, thus bridging the seams between the cover's panels to establish electrical continuity between the panels.

The electrically conductive base may be an electrically conductive adhesive which performs the additional function of adhering the cover to the core of the ball. Other types of electrically conductive bases may be employed.

For example, the electrically conductive base may be an electrically conductive scrim of fibers of the type described in my U.S. Pat. No. 4,299,384. Alternatively, the electrically conductive base may be in the form of a thin, flexible woven or unwoven cloth or mat which may be bonded to the backside of the cover. An electrically conductive adhesive may also be used with the conductive scrim or mat to adhere the cover in place on the core of the ball.

An electrically conductive coating may also be applied to the fabric which is used for the tennis ball cover to enhance continuity of the electrically conductive paths in the fabric. The coating is applied to just the fabric's backside, which becomes the cover's inner side in the final construction of the ball. The coating may be applied before or after the tennis ball cover panels are cut from the fabric.

The woven fabric for the tennis ball cover may advantageously be needled to reorient a multitude of the electrically conductive and nonconductive fibers in the woven yarn preferably without fracturing the fibers in such a manner that the reoriented fibers extend more transversely of the plane of the fabric. Because of this needling operation, free ends of other portions of a multitude of the electrically conductive fibers will project beyond the plane of the fabric at least on the backside of the fabric and will be embedded or otherwise engaged in the previously described electrically conductive base (if used) or the previously described electrically conductive coating (if used) to enhance the electrical continuity of the ball's electrically conductive paths along the backside of the cover.

The fill yarn and the weaving pattern of the fill with the warp, as well as the other features of this invention, serve to reduce the number of electrically conductive fibers which are required to make the ball sufficiently conductive to operate the ball-sensing circuits on the tennis court. By reducing the required number of electrically conductive fibers, objectionable discoloration of the ball is avoided where the color of the fabric's electrically conductive fibers is dissimilar to the color of the ball's cover. Furthermore, the fill yarn, the weaving pattern of the cover, and the other features of this invention do not impair the desirable playing characteristics of the ball even where stainless steel fibers are used.

According to another feature of this invention, the tennis ball is made significantly more conductive than the electrical conductivity of water, and the ball-sensing circuits are designed so that they are insensitive to the presence of water on the tennis court, but yet are sufficiently sensitive to sense the greater current conducted by the electrically conductive ball. This feature therefore prevents the occurrence of false signals due to the presence of water on the court, but yet provides an appropriate signal upon touchdown of the ball.

With the foregoing in mind, a major object of this invention is to provide a novel electrically conductive tennis ball which has a high degree of electrical conductivity, which is economical to manufacture, and which does not degrade the playing characteristics of the ball or objectionably discolor the ball.

A more specific object of this invention is to provide a novel electrically conductive tennis ball in which the fabric's electrically conductive fibers are electrically interconnected by treating the backside of the fabric or the tennis cover with an electrically conductive material such as a coating, an electrically conductive adhesive, an electrically conductive scrim, or an electrically conductive cloth.

Another important object of this invention is to provide a novel electrically conductive tennis ball in which the electrical conductivity of the ball is greater than the conductivity of water.

Yet another object of this invention is to provide a novel line calling system which senses touchdown of an electrically conductive tennis ball, but not the presence of water on the tennis court to avoid false signals due to water on the court.

Further objects of this invention will appear as the description proceeds in connection with the below-described drawings and annexed claims.

DETAILED DESCRIPTION

Figure 1:
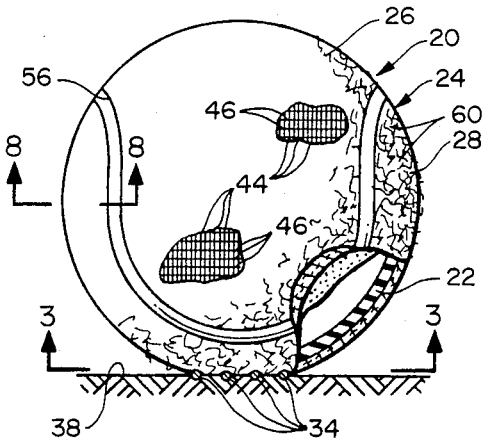
FIG. 1 is an elevation of an electrically conductive tennis ball incorporating the principles of this invention, and showing the ball touching down against a tennis court surface containing ball-sensing conductors of an electrical line calling system.

Referring to FIG. 1, the electrically conductive tennis ball incorporating the principles of this invention is indicated at 20 and comprises an inner, hollow, elastically deformable sphere or core 22 and a two-piece cover 24. Core 22 is of any suitable conventional construction and may be formed from rubber or other suitable elastically deformable material. The interior of core 22 may be filled with air or other gas under pressure.

Cover 24 is conventionally divided into two figure-eight or dumbbell panels 26 and 28 which are die cut from a bolt or sheet of woven fabric or cloth 30 (see FIG. 4) and which are glued, adhered or otherwise affixed to the outer surface of core 22.

Figure 2:
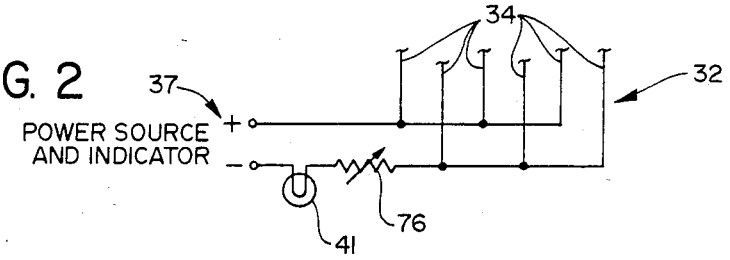
FIG. 2 is a simplified schematic circuit diagram of an electrical sensing circuit which is used to sense or detect touchdown of the ball in a line calling system.

Any suitable electrical sensing circuit may be used with ball 20 for sensing touchdown of the ball in selected areas on a tennis court. In FIG. 2, a simplified form of the electrical sensing circuit is indicated at 32 and is shown to comprise a plurality of exposed, preferably parallel spaced apart conductors 34. The conductors of the sensing circuit are preferably embedded in the tennis court to lie flush or nearly flush with surface 38. In the illustrated example, alternate conductors of sensing circuit 32 are electrically connected to one terminal of a suitable d.c. voltage source 37, and the remaining conductors in circuit 32 are electrically connected to the other terminal of the voltage source.

Figure 3:
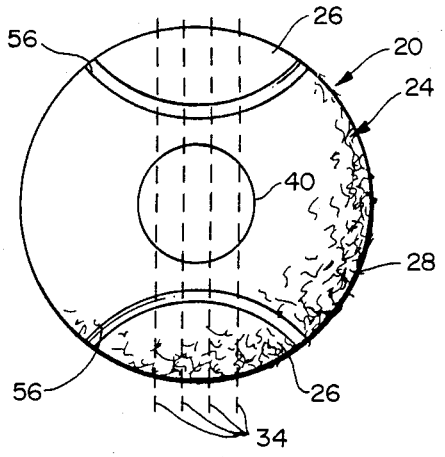
FIG. 3 a bottom plan view of the ball as viewed from lines 3—3 of FIG. 1.

When ball 20 touches down on surface 38, it deforms to form a generally flat, circular touchdown area or rebounding area 40 (see FIG. 3) which is large enough to bridge at least two adjacent conductors in sensing circuit 32. The conductors in sensing circuit 32 are spaced apart by a nominal distance which is determined by the ball's flattened touchdown area 40. For example, the spacing between adjacent conductors in circuit 32 may be 3/16 inch for a touchdown area of as little as 1 inch in diameter. Being electrically conductive, ball 20 will, upon touchdown in the area occupied by circuit 32, bridge two or more adjacent conductors in circuit 32 to thus complete a current-conducting circuit between at least two adjacent conductors in the sensing circuit.

The completion of the circuit across adjacent conductors of circuit 32 results in the conduction of current through ball 20 from source 37. This current is utilized to operate an indicating device 41 to signal the players that the ball landed in the selected area occupied by the conductors of circuit 32.

A suitable sensing circuit of the type described above is disclosed in my U.S. Pat. No. 4,109,911 which issued on Aug. 29, 1978 and which is incorporated by reference into this specification.

Figure 4:
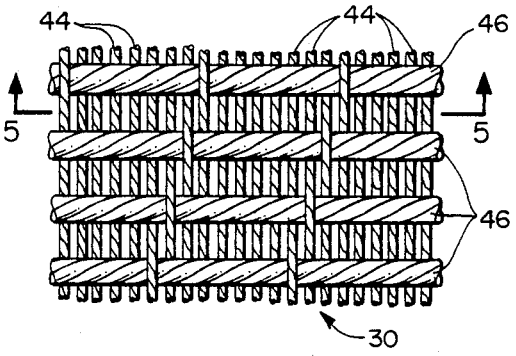
FIG. 4 is an enlarged fragmentary plan view showing the front face of the woven fabric from which the ball's cover is cut.
Figure 5:
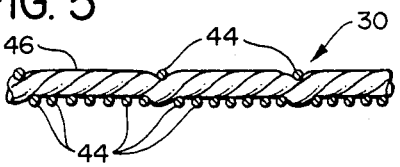
FIG. 5 is a section taken along lines 5—5 of FIG. 4.

Referring to FIGS. 4 and 5, the woven fabric 30 is a unique satin weave having a multiplicity of warp yarns 44 (or threads as they are sometimes called), or strands as they may also be called, interlaced with and extending at right angles to a multiplicity of rows or parallel lengths of woof or filling 46. It will be appreciated that multiple rows of the woof or filling 46 customarily form a part of a single yarn (or thread) by shuttling the filling yarn back and forth in the loom. These rows or parallel lengths of filling are therfore originally interconnected through the fabric's selvedges, but are separated from one another in the cover's panels 26 and 28 upon cutting the panels from fabric 30.

In this specification, the term "strands" is used to refer to the rows or parallel lengths of woof 46 in fabric 30 and in panels 26 and 28, which are cut from fabric 30. The separate parallel lengths of warp yarn are also referred to as strands. In FIG. 1, lines representing some of the parallel lengths or strands of warp and woof are shown to be spaced apart for purposes of illustration. The actual spacing of the parallel lengths of woof 46 are more accurately represented in FIG. 4.

Figure 6:
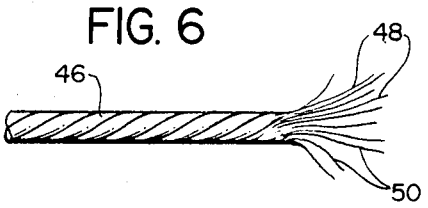
FIG. 6 is a view of a woof strand used to weave the fabric shown in FIG. 4.

Referring to FIG. 6, the woof yarn 46 is composed of a large number of electrically nonconductive filament fibers 48 of random lengths and a smaller number of electrically conductive filament fibers 50 of random lengths, such as single untwisted synthetic filaments or monofilament type fibers. The electrically conductive fibers 50 are blended with the nonconductive fibers 48 so that the conductive fibers are distributed throughout the group of nonconductive fibers. After the fibers are blended, they are twisted together as shown in FIG. 6 to form the filling 46.

The nonconductive fibers 48 may be formed from any suitable material used in manufacturing tennis ball covers such as nylon, cotton, and/or wool. The electrically conductive fibers 50 are preferably thin, finely drawn stainless steel fibers. Alternatively, the electrically conductive fibers 50 may be nylon fibers coated with silver or other electrically conductive material such as the plated or coated fibers disclosed in my U.S. Pat. No. 4,299,384, which issued on Nov. 10, 1981 and which is incorporated by reference into this specification.

Preferably, the number of nonconductive fibers 48 is much greater than the number of electrically conductive fibers 50 especially where the electrically conductive fibers are stainless steel or other material having a color dissimilar to the nonconductive fibers 48. The electrically conductive fibers may be in sufficient number to represent 10 to 30 percent of the total number of conductive and nonconductive fibers in the yarn. In the illustrated embodiment the nonconductive fibers 48 make up as much as 70 percent of total number of fibers in the woof or filling, and the electrically conductive fibers 50 make up the remaining 30 percent. After being woven, fabric 30 may be dyed to provide the cover with a suitable color such as yellow. The Lectra-Con TM 3-7093 yarn, manufactured by the Schlegel Corporation of Rochester, N.Y., is made in accordance with the foregoing teachings for the fill yarn and may be used for the fill in weaving fabric 30; alternatively, Lectra-Con TM 060-150 conductive material can be used in manufacturing fill yarn such as yarn typically used for manufacturing tennis ball covers.

The parallel lengths or strands of warp 44 are formed entirely of electrically nonconductive fibers such as nylon, cotton and/or wool. The warp fibers may also be filament fibers of random lengths, such as single untwisted synthetic filaments or monofilament type fibers, and are twisted together to form the warp strands used in weaving fabric 30. Thus, only the woof 46 of fabric 30 contains the electrically conductive fibers for making the ball's cover 24 electrically conductive.

Preferably, the warp strands 44 are very thin, and the yarn used for the woof 46 is about ten times as thick or coarse as the warp yarns or thread. The woof 46 therefore has about ten times as many fibers as the warp 44. Yarn having a Dtex of about 4400 to 5000 may be used for the woof.

The weave of fabric 30 is a conventional type used for tennis ball covers and is advantageously of the type in which each length or row of the woof or filling 46 passes or skips over more warp strands 44 than it passes under as viewed from the fabric's front face. The front face of fabric 30 is shown in FIG. 4 and is used as the outer side of the tennis ball cover 24 in the finished product.

For each warp strand that it passes under, filling 46 may pass over five to seven warp strands 44 (i.e., under one and over five to seven). For each group of eight successive warp strands 44 in the embodiment shown in FIG. 4, each row of the woof 46 passes under one warp strand and over the other seven. Because of this type of weave and because of the much greater thickness of the woof 46, more fillings than warp show on the front face of fabric 30 so that the fillings 46 dominate the front face of the fabric and occupy most of the surface area on the front face of fabric 30. Because of this fabric construction, the woof 46 will occupy a substantially greater area of the outer periphery of the tennis ball cover as compared with the area occupied by the warp 44.

Because of the large number of electrically nonconductive fibers and the relatively small number of electrically conductive fibers in each of the woof strands 46, stainless steel fibers or the like may be used in the woof without cuasing any unacceptable discoloration of the tennis ball cover.

After the weaving operation, fabric 30 may be felted by subjecting it in a conventional manner to pressure and heat so as to press the woven fabric.

After the felting operation, fabric 30 may advantageously be needled to reorient a substantial majority of the electrically conductive fibers in the filling 56 without fracturing the conductive or nonconductive fibers. The electrically nonconductive fibers in the warp 44 and woof 46 will also be reoriented by the needling operation, but only the reorientation of the electrically conductive fibers is of significance.

Figure 7:
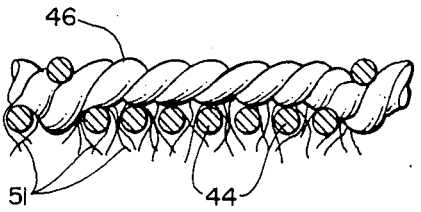
FIG. 7 is an enlarged section similar to FIG. 5 and showing the reorientation of fibers after the fabric is needled.

Before needling, the fibers in warp 44 and woof 46 lie generally in the plane of fabric 30 as shown in FIG. 5. After needling, a large number of the electrically conductive fibers 50 in the filling 46 will have portions 51 (FIG. 7) reoriented to extend generally transversely of the plane of fabric 30 as shown in FIG. 7 so that the needled portion (which includes some free ends) of the electrically conductive fibers 50 extends beyond the plane of fabric 30 on the fabric's inner or reverse side, which will be used as the inner or backside of cover 24. The needling operation may be such that portions of a multitude of the electrically conductive fibers 50 extend beyond the plane of the fabric on both sides or faces of the fabric.

Any suitable needling machine having fine or thin needles (not shown) may be used to needle fabric 30 in the manner described above. One suitable type of needle is described and shown in my U.S. Pat. No. 4,299,384. Alternatively, needles having axially oppositely facing notches may be utilized to catch the fibers during both the advancing and retracting strokes of the needles, thus reorienting the caught fibers in such a way that portions of the caught fibers project transversely from both sides or faces of fabric 30.

After fabric 30 is needled in the manner described above, it then is advantageously napped on the front face and sheered so that cover 24 will have the usual fuzziness on its outer periphery. After these operations, panels 26 and 28 are die cut from fabric 30. It will be appreciated that the process steps of felting, needling and napping may be performed after panels 26 and 28 are cut from fabric 30, but it obviously is more convenient and economical to perform these operations before the panels are cut from the fabric.

Upon being cut from the fabric, panels 26 and 28 are cemented or adhered to the ball's core 22. An electrically nonconductive adhesive or cement may be used for this purpose, but an electrically conductive adhesive is preferred. The electrically conductive adhesive forms a thin layer 54 (see FIG. 8) peripherally around the entire outer surface of core 22 between core 22 and panels 26 and 28. An example of a suitable electrically conductive adhesive is the Vulcan Corporation particulate carbon XC-72 uniformly mixed with any suitable rubber cement for manufacturing tennis balls in an amount sufficient to achieve the desired 1conductivity of the ball. The conductive and nonconductive fiber portions 51 which are reoriented by the previously described needling operation will be embedded in adhesive layers 54 and will be securely fixed or held in place by the adhesive.

Because fibers 48 and 50 are relatively long and are twisted together to form the yarn for weaving fabric 30, they will be retained in place and therefore will not come loose and fall onto the court when subjected to impact forces during play. Furthermore, retention of the fibers which have been reoriented by the previously described needling operation is enhanced by embedding the reoriented portions 51 in adhesive layer 54. This construction therefore avoids the objectionable condition where conductive fibers come loose and fall onto the sensing circuit 32 to produce a false signal.

From the foregoing description, it will be appreciated that the electrically conductive fibers 50 create a maze of electrically conductive networks 60 (FIG. 1) which are distributed throughout the entire periphery of the ball. Networks 60 define a multiplicity of current-conducting paths passing through cover 24 and extending along the outer side of cover 24 for completing a circuit between adjacent conductors in sensing circuit 32 upon touchdown of the tennis ball on circuit 32. The portions of networks 60 lying on the outer periphery of cover 24 are distributed throughout the entire outer surface of the cover so that a signal is produced regardless of the orientation of the ball upon touchdown on the conductors of sensing circuit 32.

In addition to being in contact with the needled portions of fibers 50, the electrically conductive adhesive layer 54 will also be in contact with some of the unneedled electrically conductive fibers in the portions of fill 46 which loop under the warp 44 to appear on the backside of cover 24. Most of the networks 60 are therefore interconnected through the electrically conductive adhesive layer 54 which forms an electrically conductive base lying entirely along the inner side of cover 24.

The electrical conductivity of the tennis ball for signalling touchdown of the ball on sensing circuit 32 is significantly enhanced because of the large exterior surface area occupied by the woof in cover 24, the presence of the electrically conductive adhesive base 54 on the inner side of cover 24, and the reorientation of a multitude of the electrically conductive fibers 50 by the previously described needling operation.

Figure 8:
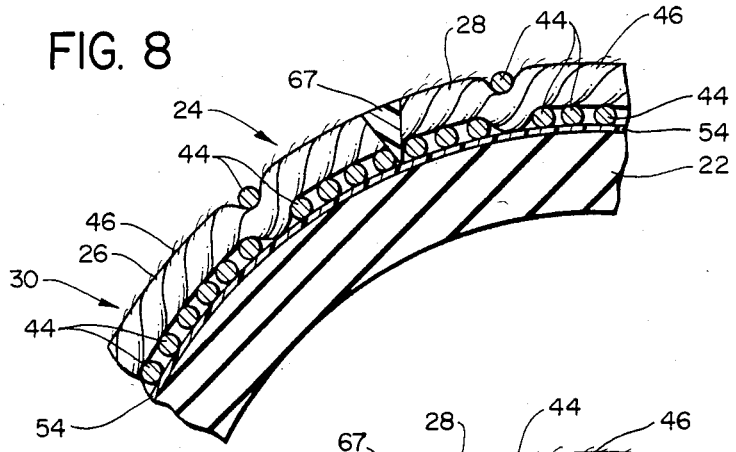
FIG. 8 is an enlarged fragmentary section taken along lines 8—8 of FIG. 1.

In a modified embodiment of the ball illustrated in FIG. 8, adhesive layer 54 can be made of a non-conductive material and an electrically conductive coating can be applied to the back of the cloth formed by warp 44 and fill 46. This electrically conductive coating would substantially fill the spaces between the fibers of warp 44 and thus serves the same function as the electrically conductive adhesive layer 54.

Figure 9:
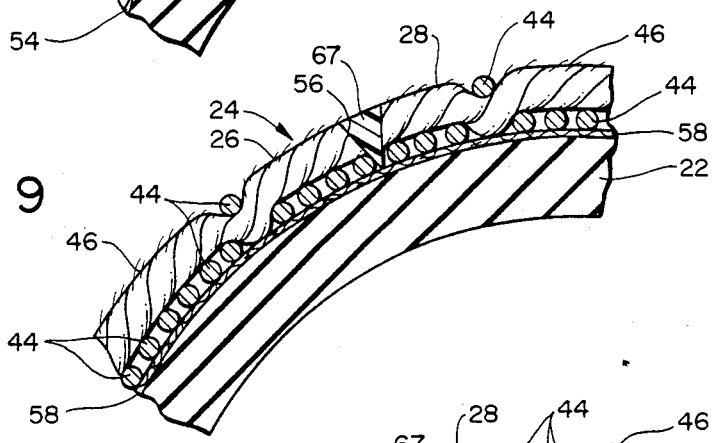
FIG. 9 is an enlarged section similar to FIG. 8 but showing a modification of the ball.

Referring to FIG. 9, a seam 56 is conventionally formed between panels 26 and 28. The electrically conductive adhesive layer 54 bridges seam 56 to ensure electrical continuity between panels 26 and 28. Seam 56 is preferably filled with any suitable, conventional nonconductive cement. Alternatively, a conductive seam cement may be used, but the conductive carbon particles in the cement produce an undesirable discoloration of the ball. If panels 26 and 28 are closely matched, they will butt against each other at the apex of seam 56 to enhance electrical continuity between panels 26 and 28.

In the embodiment shown in FIG. 9, an electrically conductive scrim 58 is sandwiched between cover 24 and core 22 to establish the electrically conductive base on the backside of cover 24. Scrim 58 is made up of an unwoven open mesh of fibers strung together in an irregular array in a unitary unwoven body. Preferably, all of the fibers in scrim 58 are electrically conductive. Scrim 58 extends around and covers the entire periphery of core 22. Scrim 58 therefore bridges seam 56 and lies entirely between core 22 and cover 24.

Like the previously described electrically conductive adhesive layer 54, scrim 58 also lies in contact with needled portions of fibers 50 and also in contact with some of the unneedled electrically conductive fibers in the portions of fill 46 which loop under the warp 44, thus enhancing the conductivity of the ball and establishing electrical continuity between panels 26 and 28. Scrim 58 may be adhered to core 22 and cover 24 with either an electrically nonconductive adhesive or an electrically conductive adhesive. It will be appreciated that scrim 58 is tightly pressed between cover 24 and core 22.

Scrim 58 may be arranged in a stretched-out sheet on the back or reverse sides of panels 26 and 28, and the composite of each panel and the scrim may then be adhered or cemented to core 22 with an electrically conductive or nonconductive adhesive. The usual nonconductive cement used for adhering the tennis ball cover to the core of the ball is considered to be one type of adhesive. Scrim 58 may also be placed on the back or reverse sides of fabric 30 before the fabric is needled.

Figure 10:
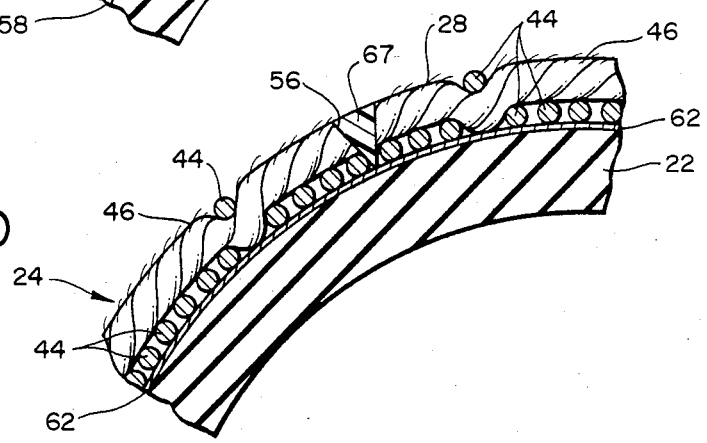
FIG. 10 is an enlarged section similar to FIG. 8 and showing another modification of the ball.

In the embodiment shown in FIG. 10, scrim 58 is replaced with a thin, woven or unwoven cloth or mat 62 which is sandwiched between and adhered to cover 24 and core 22 with an electrically conductive or nonconductive adhesive. Mat 62 may be formed from any suitable material and may be adhered to core 22 before application of cover 24. In the finished construction of ball 20, mat 62 contacts the needled portions of the electrically conductive fibers 50 and some of the unneedled electrically conductive fibers in the portions of fill 46 which loop under the warp 44 to establish electrical continuity between panels 26 and 28.

Instead of applying mat 62 to core 22 before placing cover 24 on the core, mat 62 may be adhered to the back or reverse side of fabric 30 with an electrically conductive or nonconductive adhesive before the fabric is needled and before panels 26 and 28 are cut from the fabric. After the panels are cut from fabric 30, the panel and mat composite may then be adhered to core 22 with an electrically conductive or nonconductive adhesive.

Figure 11:
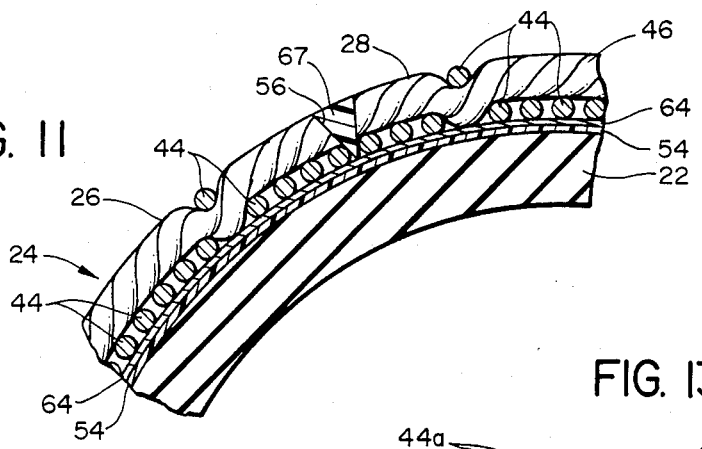
FIG. 11 is an enlarged section similar to FIG. 8 and showing yet another modification of the ball.

Instead of employing scrim 58 or mat 62, the reverse or back side of fabric 30 (i.e., the side which becomes the inner side of cover 24) may be coated throughout with an electrically conductive coating 64 (see FIG. 11) after fabric 30 is needled in the manner described above and preferably after fabric 30 is napped and before panels 26 and 28 are cut from the fabric. Coating 64 is applied with sufficient thickness and in such a manner that the reoriented portions of the needled fibers, including fibers 50, become embedded and fixed in coating 64 to enhance the electrical conductivity of the ball. Additionally, coating 64 will partially impregnate fabric 30 from the reverse side thereof to electrically interconnect a large number of the unneedled electrically conductive woof fibers 50 still lying in the plane of fabric 30.

Coating 64 may be conventional and may be of any suitable type. For example, coating 64 may be Schlegel Corporation's latex base coating R3115-000-2.

After coating 64 is applied, panels 26 and 28 are die cut from fabric 30. Thus, coating 64 will form a continuous uninterrupted electrically conductive base along the entire inner surface areas of each of the panels 26 and 28 after the panels are cut from fabric 30.

It will be appreciated that coating 64 may alternatively be applied to panels 26 and 28 after they are cut from fabric 30.

Upon being cut from the coated fabric, panels 26 and 28 are adhered to the ball's core 22 by an electrically conductive or nonconductive adhesive.

Figure 12:
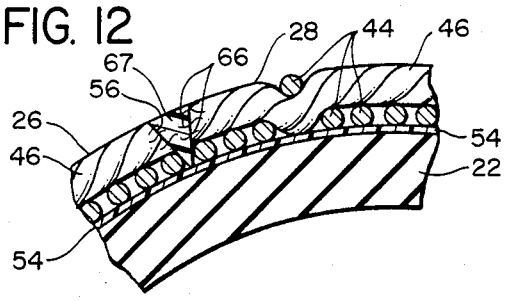
FIG. 12 is an enlarged section similar to FIG. 8 and showing yet another modification in which some of the electrically conductive fibers have dangling ends lying in the seam between the panels of the cover to establish electrical continuity between the cover's panels.

Electrical continuity between panels 26 and 28 may be established by separating the panels from fabric 30 in such a way that a substantial number of the conductive fibers 50 are left with ends 66 (FIG. 12) that dangle from the edge of each panel. This may be accomplished by only partially die cutting panels 26 and 28 from fabric 30 (that is cutting the fabric only partially around the periphery of each of the panels or cutting only partially through the fabric on spaced apart regions) and by pulling the partially cut panels loose from the remainder of the fabric in such a manner that ends 66 dangle from the edge of each of the panels at the regions where the panels were not fully cut from the fabric.

Upon adhering panels 26 and 28 in place on the core of the ball, the dangling ends 66 from the two panels will interengage or become entangled to establish electrically conductive paths which bridge the seam between the two panels. Ends 66 will be embedded in the seam cement 67 (FIG. 12) or other material used to fill seam 56 and thus will be fixed in place by the seam cement. If desired, the seam material may be electrically conductive.

By utilizing the fiber ends 66 to establish electrical continuity between panels 26 and 28 and by using electrically conductive warp strands, the electrically conductive base (namely, adhesive layer 54, scrim 58 or mat 62) may be omitted from the ball, and cover 24 may be adhered to core 22 with an electrically nonconductive adhesive. Closely matching of panels 26 and 28 which butt together at the apex of seam 56 may even establish sufficient electrical continuity between panels 26 and 28 to obviate the need for panels with the dangling ends 66 or an electrically conductive seam-bridging base.

In accordance with a further feature of this invention, the electrically conductive networks 60 are made significantly more conductive than water, and the ball-sensing circuit 32 is designed so that it is insensitive to water on the tennis court surface. This may be accomplished by providing an adjustable resistance 76 (see FIG. 2) in series with the voltage power source 37. Alternatively, a comparator (not shown) may be used to compare the ball-produced electrical signal with a fixed reference signal in such a way that a false signal produced by water between adjacent conductors in circuit 32 is insufficient to switch the output of the comparator. However, the stronger signal produced by the more conductive tennis ball will switch the comparator's output, thus signalling touchdown of the ball in the area occupied by the sensing circuit.

Preferably, the resitivity (which is the reciprocal of conductivity) of the electrically conductive tennis ball of this invention is equal to between 10 and 500 ohms per square.

Figure 13:
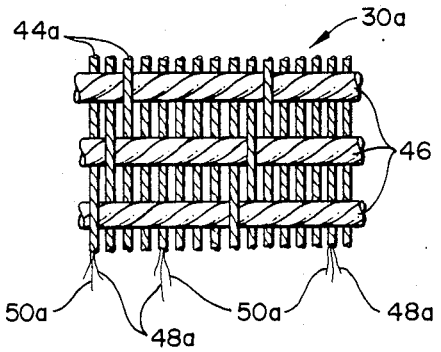
FIG. 13 is a fragmentary plan view similar to FIG. 4, but showing another embodiment of this invention.
Figure 14:
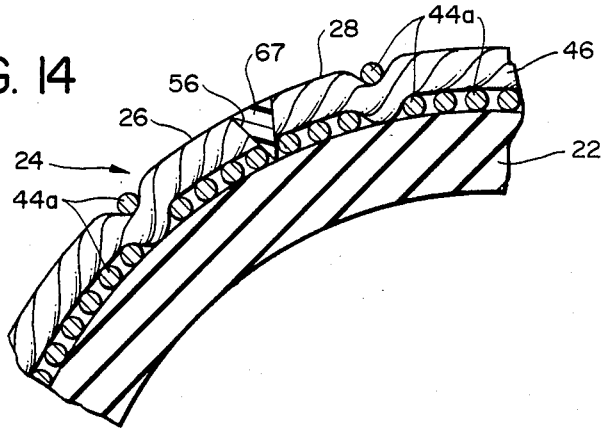
FIG. 14 is a section similar to FIG. 3 but showing a tennis ball having a cover made from the fabric of FIG. 13.

Referring to FIGS. 13 and 14, an alternate woven fabric **30*a* may be used for cover 24 and is the same as fabric 30 except that the warp yarn or strands 44*a* in fabric 30*a* also contain electrically conductive fibers to further enhance the electrical conductivity of the ball and to negate the need for scrims, conductive coatings or conductive adhesives. The fill in fabric 30*a* is the same as the fill in fabric 30**. Like reference numerals have been therefore applied to designate like elements of the fill yarns for the two fabrics.

In the embodiment of FIGS. 13 and 14, a quantity of electrically conductive fibers **50*a* are blended with a much larger number of electrically nonconductive fibers 48*a*, and the blended fibers are twisted or spun together to form the yarn for the warp 44*a*. The ratio of conductive fibers to nonconductive fibers in warp 44*a* preferably is less than but may be the same as or greater than the ratio of conductive fibers to nonconductive fibers in the fill 46. Fibers 50*a* are preferably the same as fibers 50, and fibers 48*a* may be the same as fibers 48. The woven pattern of fabric 30*a* is the same as that of fabric 30**.

In this specification (including the claims herein) the term "yarn" is considered to include a thread and any other type of yarn. A thread is considered to be a yarn having a noticeable twist.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency are therefore intended to be embraced therein.

What is claimed and desired to be secured by Letters Patent is:

1. An electrically conductive tennis ball for use with an electrical detection circuit in which touchdown of the ball in a selected area is detected by completion of a circuit between spaced apart electrical conductors extending along said area, said electrically conductive tennis ball comprising an elastically deformable sphere, a cover of woven fabric covering said sphere, said fabric being woven with a set of warp strands interlaced with a set of woof strands, the strands of one of said sets comprising a quantity of electrically conductive fibers and a quantity of electrically nonconductive fibers, and the strands of the other of said sets being composed entirely of electrically nonconductive fibers.

2. The electrically conductive tennis ball defined in claim 1 wherein said fabric has a weave in which the area occupied by the strands of said one of said sets on the outer surface of said cover is greater than the area occupied by the strands of said other of said sets.

3. The electrically conductive tennis ball defined in claim 2 wherein the strands of said one of said sets are thicker than the strands of the other of said sets.

4. An electrically conductive tennis ball for establishing a current-conducting path across spaced apart electrical conductors extending along a selected area of a tennis court and/or the top surface of a net, said electrically conductive tennis ball comprising an elastically deformable sphere and a cover of woven fabric covering said sphere, said fabric being uniform over the entire surface of the ball and: (a) having a set of strands of warp yarn interlaced with and extending transversely of a set of strands of woof yarn with the yarn for the strands in at least one of said sets being formed of a plurality of electrically conductive fibers with metal surfaces and electrically nonconductive fibers which are twisted together and the number of said electrically nonconductive fibers exceeding the number of said electrically conductive fibers in the yarn for the strands of said at least one of said sets to the extent that excessive discoloration of said cover by said electrically conductive fibers is avoided, or (b) having a set of warp strands interlaced with a set of woof strands with the strands of one of said last mentioned sets comprising a quantity of electrically conductive filament fibers with metal surfaces and of random lengths and a quantity of electrically nonconductive filament fibers mixed with said conductive fibers, said conductive and nonconductive filament fibers being twisted together to form the yarn for said one of said sets of strands.

5. The electrically conductive tennis ball defined in claim 4 comprising a base of electrically conductive material formed separately of said cover and lying between said cover and said sphere without passing through said cover, said base being in contact with and electrically interconnecting at least some of said electrically conductive fibers to provide at least one electrically conductive network for conducting electrical current through one or more of the electrically interconnected electrically conductive fibers from the outer side of the cover to said base, through said base along the inner side of the cover, and through one or more additional ones of the electrically interconnected electrically conductive fibers from said base to the outer side of said cover.

6. The electrically conductive tennis ball defined in claim 5 wherein said cover comprises a pair of panels which are divided by a seam, and wherein said base bridges said seam to establish electrical continuity between said panels.

7. The electrically conductive tennis ball defined in claim 6 wherein said base is an electrically conductive adhesive which adheres said panels to said sphere.

8. The electrically conductive tennis ball defined in claim 6 wherein said base is a scrim comprising unwoven electrically conductive fibers, there being an adhesive for adhering the composite of said cover and scrim to said sphere.

9. The electrically conductive tennis ball defined in claim 6 wherein said base is an electrically conductive mat.

10. The electrically conductive tennis ball defined in claim 4, wherein said electrically conductive fibers form a part of the woof of said fabric, wherein the warp strands of said fabric are composed entirely of electrically nonconductive fibers, and wherein said fabric has a weave in which the area occupied by the woof of said fabric on the outer surface of said cover is greater than the area occupied by the warp of said fabric.

11. The electrically conductive tennis ball defined in claim 4 wherein the yarn defining the strands in the other of said sets is formed by electrically conductive and electrically nonconductive fibers which are intermixed and twisted together.

12. The electrically conductive tennis ball defined in claim 4 wherein at least some of said electrically conductive fibers each have at least one portion which is reoriented after said fabric is woven to extend transversely of the plane of the fabric.

13. The electrically conductive tennis ball defined in claim 4 wherein said fabric has a weave in which the area occupied by the strands of said one of said sets on the outer surface of said cover is greater than the area occupied by the strands of the other of said sets.

14. The electrically conductive tennis ball defined in claim 4 wherein only the yarn in said woof contains electrically conductive fibers and wherein each of said woof strands is passed over a larger number of warp strands than it is passed under to increase that portion of the exposed surface of the covering that is covered by the woof.

* * * * *